US008938194B2

(12) United States Patent
Keino et al.

(10) Patent No.: US 8,938,194 B2
(45) Date of Patent: Jan. 20, 2015

(54) IMAGE HEATING APPARATUS

(71) Applicant: Canon Kabushiki Kaisha, Tokyo (JP)

(72) Inventors: Takuya Keino, Mishima (JP); Hiroshi Sahara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 13/672,045

(22) Filed: Nov. 8, 2012

(65) Prior Publication Data

US 2013/0121737 A1 May 16, 2013

(30) Foreign Application Priority Data

Nov. 15, 2011 (JP) ..... 2011-249694

(51) Int. Cl.
*G03G 15/20* (2006.01)

(52) U.S. Cl.
CPC .... *G03G 15/2017* (2013.01); *G03G 2215/2035* (2013.01)
USPC ..... 399/329

(58) Field of Classification Search
CPC ..... G03G 15/2089
USPC ..... 399/329, 122
See application file for complete search history.

(56) References Cited

U.S. PATENT DOCUMENTS

| | | | | |
|---|---|---|---|---|
| 7,570,895 | B2 | 8/2009 | Ando et al. | |
| 7,773,931 | B2 | 8/2010 | Jung et al. | |
| 7,792,448 | B2 | 9/2010 | Ando et al. | |
| 7,962,082 | B2 * | 6/2011 | Takahashi et al. | 399/328 |
| 2005/0201114 | A1 * | 9/2005 | Komatsu | 362/509 |
| 2008/0232871 | A1 * | 9/2008 | Jung et al. | 399/329 |
| 2009/0016789 | A1 * | 1/2009 | Kim et al. | 399/329 |
| 2009/0110451 | A1 * | 4/2009 | Jung et al. | 399/329 |
| 2010/0067929 | A1 * | 3/2010 | Seki | 399/45 |
| 2010/0119247 | A1 * | 5/2010 | Seol et al. | 399/67 |
| 2013/0136515 | A1 * | 5/2013 | Sahara | 399/329 |

FOREIGN PATENT DOCUMENTS

| | | | |
|---|---|---|---|
| JP | 6-3984 | A | 1/1994 |
| JP | 2002-72731 | A | 3/2002 |
| JP | 2007-328222 | A | 12/2007 |
| JP | 2008-145903 | A | 6/2008 |
| JP | 2009-104114 | A | 5/2009 |
| JP | 2010-262208 | A | 11/2010 |

* cited by examiner

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

An image heating apparatus includes an endless belt; a heater, provided in an interior of the endless belt, for heating the endless belt; a back-up member contacted to an inner surface of the endless belt; a pressing member for forming a nip for nipping and feeding a recording material together with the back-up member through the endless belt; and a protecting member, provided surrounding the heater in the interior of the endless belt and rotatable around the heater, the protecting member includes a shield portion for blocking between the endless belt and the heater and an opening, arranged in a circumferential direction of the protecting member.

16 Claims, 5 Drawing Sheets

IMAGE HEATING APPARATUS

FIELD OF THE INVENTION AND RELATED ART

The present invention relates to an image heating apparatus usable with an image forming apparatus such as a copying machine, a laser beam printer or the like using an image formation process of an electrophotographic type, an electrostatic recording type or the like. The image heating apparatus may be a fixing device for heat-fixing a formed on a recording material into a fixed image, a glossiness increasing device for increasing a glossiness of the image by heating the image fixed on the recording material, or the like.

A heating roller type is known as an image heating apparatus used in image forming apparatus of the electrophotographic type, the electrostatic recording type or the like. However, in an image heating apparatus of the heating roller type, a large amount of electric power and time are required to heat a heat roller having a large thermal capacity. Japanese Laid-open Patent Application 2009-104114 proposes an image heating apparatus, heating belt (belt type image heating apparatus) to save energy and to reduce FPOT (First Page Out Time).

Part (a) of FIG. 7 shows an example of the belt type image heating device. In the image heating apparatus of the belt type, a heating belt 1 and a pressing member 2 press-contacted with each other, and a sliding member 3 as a back-up member for close contacting and driving the heating belt 1 is provided to the heating belt 1 at a position opposed to the pressing member 2. Inside the heating belt 1, there is provided a heating source for heating the inner surface of the heating belt 1 and the sliding member 3. The heating source 6 includes a halogen lamp, which produces radiant heat which in turn heats the inner surface of the heating belt 1 and the sliding member 3. The inner surface of the heating belt 1 is colored black to enhance the heat transfer efficiency.

The sliding member 3 is supported by a sliding plate holding member 4 for forming a uniform nip N between itself and the pressing member 2, and the sliding plate holding member 4 is supported and pushed by a supporting member 5 for pressing the sliding plate holding member 4 uniformly in the longitudinal direction. In the nip N, when the pressing member 2 feeds the heating belt 1, and feeds a recording material P which is a recording sheet carrying an unfixed image between the heating belt 1 and the pressing member 2.

During the feeding, the unfixed image on the recording material P is fixed by the heat and the pressure in the nip N. The recording material P is separated from the heating belt 1 after passing through the nip N. In order to enhance and assure the fixing property, it is required to increase heat efficiency, and from this standpoint, it is preferable that no block member exists between the heating source 6 and the heating belt 1.

However, if nothing is provided between the heating source and the heating belt, the resulting structure is such that the heating source is exposed to the heating belt, and therefore, when the heating source is a halogen lamp, for example, the following problems arise. The halogen lamp includes a high resistance member (molybdenum wire, for example) in a transparent glass casing, in which radiant heat is produced by flowing a current through the high resistance member, and the radiant heat heats the heating belt.

Therefore, if a foreign matter such as grease is deposited on the glass portion of the halogen lamp, the radiant heat is blocked, thus disturbing the uniform heating. In addition, an abnormally high temperature results locally at the portion where the foreign matter is deposited, and a temperature difference occurs, which may leads to a breakage of the halogen lamp due to the thermal expansion difference.

Part (b) of FIG. 7 such a heating belt type image heating device, wherein sheet jamming has occurred adjacent the image heating apparatus. Designated by P is the recording sheet jammed in the image heating apparatus, 28 is a feeding guide provided following the image heating apparatus. Designated by 1 is a heating belt deformed by the sheet jamming, and 6 is a halogen lamp. The recording material P heated and fed by the nip N easily adheres to the heating belt 1 due to the melted toner, and if it is not properly separated from the belt, the leading end of the recording material P engages with the feeding guide 28.

While the recording material P repeats separating and contacting the heating belt 1, the recording material P is pushed into the image heating apparatus, and the sheet jamming occurring in the downstream of the image heating apparatus results in bellow of the sheets. When the sheet jamming occurs in the downstream side of the image heating apparatus as shown in part (b) of FIG. 7, a load is applied to the heating belt 1 with the result that the belt is deformed inwardly. In addition, when the bellowed recording material P is removed, a load of deforming the heating belt 1 toward the inside by pulling the recording material P in the direction indicated by an arrow in part (b) of FIG. 7.

At this time, the heating source 6 may be damaged by the contact between the heating belt 1 and the heating source 6 or by deposition of the foreign matter such as the grease from the inner surface of the belt to the heating source. If the heating belt 1 is creased or cracked by the inward deformation, uniform heating of the heating belt 1 would not be possible. Furthermore, it may be difficult to detect the temperature of the heating belt 1, which leads to poor fixing property. With the downsizing of the image heating apparatus, the distance between the inner wall of the heating belt 1 and the heating source 6 decreases, and therefore, the above-described problems are more significant.

SUMMARY OF THE INVENTION

Accordingly, it is a principal object of the present invention to provide an image heating apparatus in which the heating source is prevented from contacting with the belt and/or from the deposition of the foreign matter.

According to an aspect of the present invention, there is provided an image heating apparatus comprising an endless belt; a heater, provided in an interior of said endless belt, for heating said endless belt; a back-up member contacted to an inner surface of said endless belt; a pressing member for forming a nip for nipping and feeding a recording material together with said back-up member through said endless belt; and a protecting member, provided surrounding said heater in the interior of said endless belt and rotatable around said heater, said protecting member includes a shield portion for blocking between said endless belt and said heater and an opening, arranged in a circumferential direction of said protecting member.

According to another aspect of the present invention, there is provided an image forming apparatus comprising an image forming station for forming an unfixed image on a recording material; a fixing portion for heating and fixing the unfixed image formed on the recording material on the recording material; wherein said fixing portion including, an endless belt; a heater, provided in an interior of said endless belt, for heating said endless belt; a back-up member contacted to an inner surface of said endless belt; a pressing member for forming a nip for nipping and feeding a recording material together with said back-up member through said endless belt; and a protecting member, provided surrounding said heater in the interior of said endless belt and rotatable around said heater, said protecting member includes a shield portion for blocking between said endless belt and said heater and an opening, arranged in a circumferential direction of said protecting member.

According to a further aspect of the present invention, there is provided an image heating apparatus comprising an endless belt; a heater, provided in an interior of said endless belt, for heating said endless belt; a back-up member contacted to an inner surface of said endless belt; a pressing member for forming a nip for nipping and feeding a recording material together with said back-up member through said endless belt; and a protecting member, provided in an interior of said endless belt, for protecting said heater, said protecting member being movable between a first position for permitting said heater to heat said endless belt and a second position for protecting said heater from being contacted by said endless belt.

According to a further aspect of the present invention, there is provided an image forming apparatus comprising an image forming station for forming an unfixed image on a recording material; a fixing portion for heating and fixing the unfixed image formed on the recording material on the recording material; wherein said fixing portion including, an endless belt; a heater, provided in an interior of said endless belt, for heating said endless belt; a back-up member contacted to an inner surface of said endless belt; a pressing member for forming a nip for nipping and feeding a recording material together with said back-up member through said endless belt; and a protecting member, provided in an interior of said endless belt, for protecting said heater, said protecting member being movable between a first position for permitting said heater to heat said endless belt and a second position for protecting said heater from being contacted by said endless belt.

These and other objects, features, and advantages of the present invention will become more apparent upon consideration of the following DESCRIPTION OF THE PREFERRED EMBODIMENTS: of the present invention, taken in conjunction with the accompanying drawings.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

<First Embodiment>

(Image Forming Apparatus)

Figure 5:
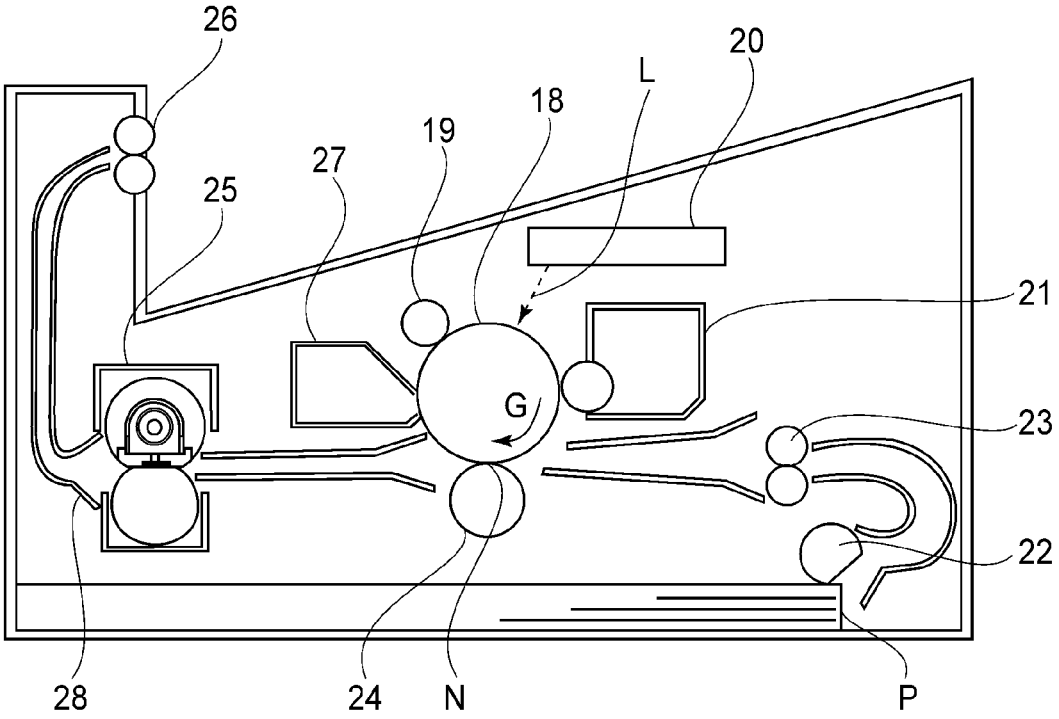
FIG. 5 is a schematic sectional view of an image forming apparatus including the image heating apparatus according to the embodiment of the present invention.

Referring first to FIG. 5, there is shown a general arrangement of an image forming apparatus including an image heating apparatus according to a first embodiment of the present invention. The image forming apparatus is a laser beam printer using an electrophotographic type laser beam printer. The image forming apparatus includes a drum type electrophotographic photosensitive member (photosensitive drum) 18, and a charging member 19, a developing device 21 and a cleaning device 27 which are provided around the photosensitive drum 18. It further includes an exposure device 20 to form a latent image on the photosensitive drum 18.

The photosensitive drum 18 is an OPC photosensitive member and comprises a drum base member of aluminum, a photoconductive layer thereon, and is rotatable in a direction of an arrow G at a predetermined process speed by a driving device (unshown). The charging member 19 uniformly charges a surface of the photosensitive drum 18 to a negative predetermined potential by a charging bias voltage applied from of the charging bias voltage source (unshown). The developing device 21 deposits toner to the electrostatic latent image formed on the photosensitive drum 18 to develop the image into a toner image. The-developing device 21 employs a developing method in which a developer comprises a mixture of toner particles and magnetic carrier particles and is fed by a magnetic force to develop in contact with the photosensitive drum 18.

A transfer roller 24 as transferring means is made of an elastic member and is contacted to the photosensitive drum 18, and it is supplied with a high voltage in the transfer operation. The cleaning device 27 removes and collects the untransferred toner remaining on the surface of the photosensitive drum 18. In the exposure device 20, a laser output portion (unshown) outputs a laser beam modulated in accordance with a time series electrical digital pixel signal corresponding to image information, the laser beam is projected to the surface of the photosensitive drum 18 through a high speed rotation polygonal mirror (unshown) and so on. By this, an electrostatic latent image is formed on the surface of the charged (by the charging member 19) photosensitive drum in accordance with the image information.

The sheet feeding roller 22, after feeding the recording material P, feeds the recording material P to, and has a D-shaped cross-section so as to permit the following feeding.

(Operation of Image Forming Apparatus)

Operations of said image forming apparatus will be described. The printer of this embodiment receives image information from an image information providing device (unshown) such as a host computer outside the main assembly of the printer. The printer carries out an image forming process for printing the image on the recording material sheet P in response to the received image information by a known electrophotographic type process.

When the printer receives a printing signal, the rotation of the photosensitive drum 18 as the image bearing member starts. The photosensitive drum 18 is rotated in the clockwise direction at a predetermined peripheral speed. The surface of the photosensitive drum 18 is charged to a predetermined potential by a charging member 19 as a primary charging device supplied with a predetermined bias voltage. In this embodiment, a so-called reverse development type is used, and therefore, the charged potential is negative.

The portion of the surface of the photosensitive drum 18 that has been charged is scanned and exposed to the light in accordance with the image information supplied from the image information providing device, by the exposure device 20. In the exposed area, the surface potential of the photosensitive drum 18 attenuates to become positive relatively the adjacent area so that an electrostatic latent image is formed on the surface of the photosensitive drum 18 in accordance with the image information. The developer (toner) charged to the negative polarity by the developing device 21 is deposited to the exposure area which is relatively positive to visualize the latent image into a developed image on the surface of the photosensitive drum 18.

On the other hand, a recording material P is singled out and fed from a sheet feeding cassette by the sheet feeding roller 22 driven at predetermined timing. The recording material P fed from the sheet feeding cassette is fed to a transfer nip N formed between the photosensitive drum 18 and the transfer roller 24 at predetermined control timing by a pair of registration rollers 23. The toner image on the photosensitive drum 18 is transferred sequentially onto the recording material P while the recording material P is being nipped and fed in the transfer nip.

The recording material P having subjected to the transfer process is fed to the image heating apparatus 25 where the toner image is fixed, and the recording material P is then discharged to the outside of the main assembly of the printer through a pair of sheet discharging rollers. The untransferred toner remaining on the photosensitive drum is removed by a cleaning device 27, thus completing the series of image forming steps.

(Image Heating Apparatus)

Figure 1:
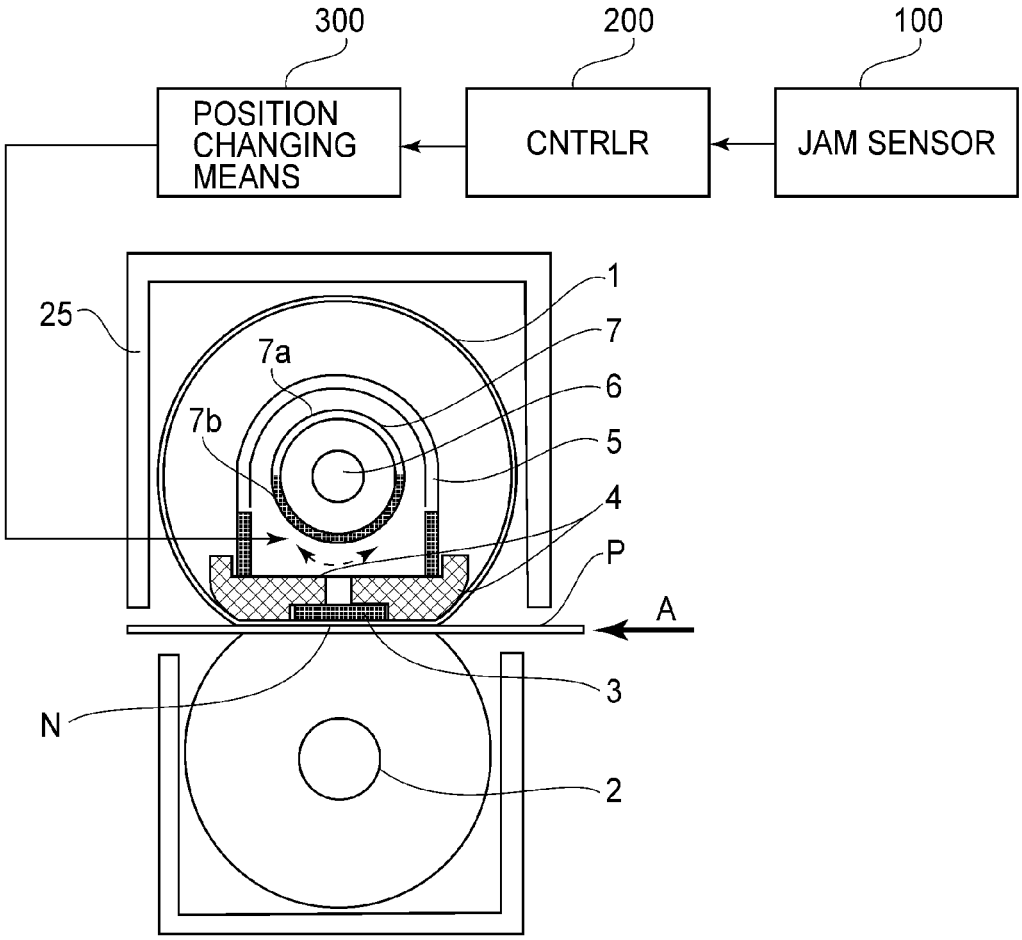
FIG. 1 is a schematic sectional view of an image heating apparatus according to an embodiment of the present invention.

The image heating apparatus 25 according to the embodiment will be described. FIG. 1 is a schematic sectional view of the image heating apparatus 25. The image heating apparatus heats and fixes the toner image formed by an image forming method using a general electrophotographic type. Designated by reference numeral 1 is a flexible heating belt (endless belt) for heating a recording material P and is rotatable. Designated by 2 is a pressing roller as a pressing member, contacted to an outside of a heating belt 1, for driving the heating belt and feeding the recording material P. Designated by 3 is a sliding plate partly constituting a back-up member contacted to a back side (inner surface) of the heating belt 1 to form a fixing nip N through the heating belt 1 by cooperation with a pressing roller 2.

The recording material P carrying the toner image is fed by feeding means (unshown) in a direction indicated by the arrow A in FIG. 1, and is passed through the nip N of the image heating apparatus by which the toner image is heated and fixed. Designated by 4 is a sliding plate holding member for holding the sliding plate 3. In this embodiment, the sliding plate and the holding member 4 are parts of the back-up member. Designated by 5 is a supporting member for forming the nip N between the sliding plate 3 and the pressing roller 2 by pressing the sliding plate 3 through the sliding plate holding member 4 by (unshown) pressing means. The back-up member is required to have a function of forming the nip by cooperation with the pressing roller 2 through the belt 1.

Designated by 6 is a heater (heating source) and is provided at a position spaced from the heating belt 1 inside the heating belt 1, preferably adjacent a central portion inside the belt. Outside the heating belt 1, a heating belt surface temperature detecting means (unshown) is provided. A temperature detected by the heating belt surface temperature detecting means is fed to control means (unshown), and the operation of the heater 6 is controlled by the control means. A temperature detecting means may be provided on the back side of the sliding plate 3 or the sliding plate holding member 4 to measure a structural member temperature inside the image heating apparatus, and a driving condition of the heater 6 may be determined on the basis of the result of detection of such a temperature detecting means, although it is not employed in this embodiment.

The heating belt 1 comprises a base material of heat resistive resin material such as polyimide, polyamide-imide, PEEK, or a metal such as nickel, SUS (Steel Use Stainless), and a parting layer. In the case that it is required to mix colors and to provide a uniform fixed image as in color toner images, it is desired to provide an elastic layer having a thickness of approx. 100-1000 μm and a parting layer thereon. A back side (sliding member side) of the heating belt 1 may be provided with a heat absorbing layer of black paint or the like.

In this embodiment, the heating belt 1 comprises a SUS base material having a thickness of 50 μm, a silicone rubber layer having a thickness of the 300 μm as the elastic layer, and a fluorine resin tube T-on as a surface parting layer. The back side of the heating belt 1 is coated with heat resistive black paint to efficiently absorb the heat from the heating source.

The pressing roller 2 comprises a core material, an elastic layer thereon and a parting layer thereon. In this embodiment, the core material is a steel core metal, and the elastic layer is a silicone rubber foam layer, and the parting layer is a fluorine resin tube.

The sliding plate 3 is a plate member of a metal plate, a ceramic plate or the like. It may be provided with pits and projections in order to change the pressures in the fixing nip. In addition, the plate member may be provided with a resin coating of fluorinated resin material or the like, or with a glass coating or the like. In this embodiment, the sliding plate 3 comprises an aluminum flat plate having a width of 10 mm, a length of 270 mm and a thickness of 1 mm, and a fluorinated resin coating on the surface of the aluminum flat plate.

The sliding plate holding member 4 is made of heat resistive resin material, metal or the like and functions to support the sliding plate3. The sliding plate holding member 4 may have a function of guiding the heating belt1. In this embodiment, the sliding plate holding member 4 is manufactured by molding LCP (liquid crystal polymer). The sliding plate holding member 4 of the embodiment is provided with a slit opening for transmitting the heat from the heater 6 directly to the sliding plate3.

Figure 2:
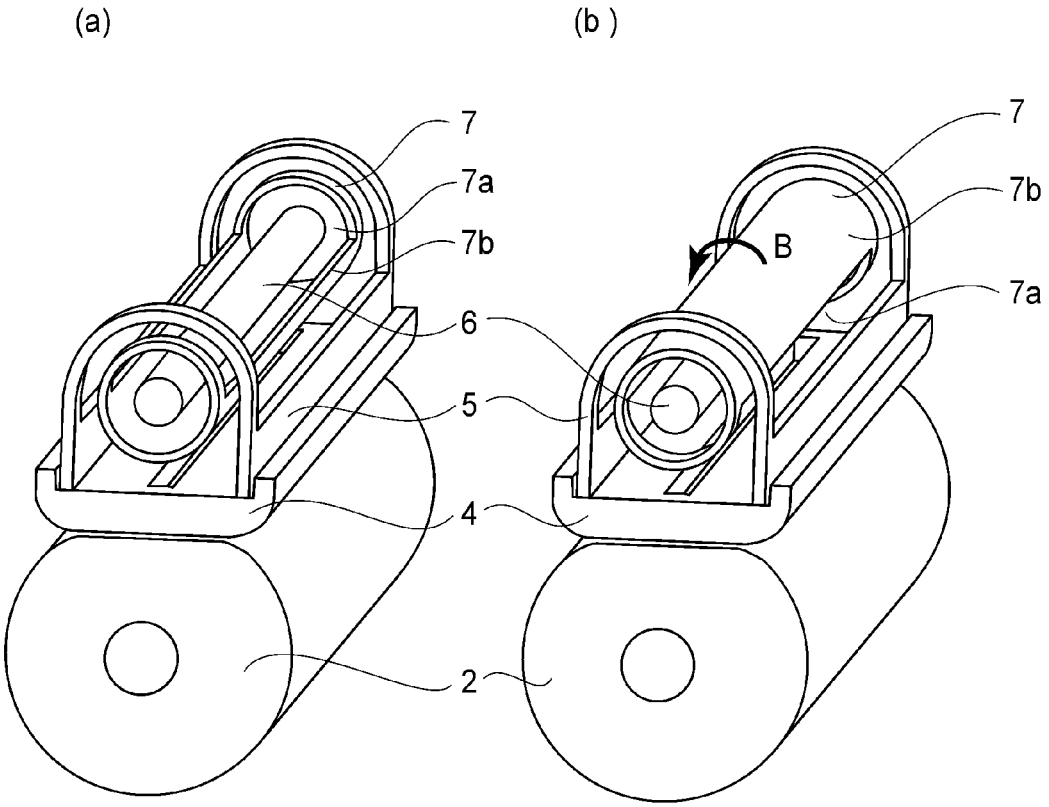
FIG. 2 is a schematic perspective view (a) of the image heating apparatus according to the first embodiment of the present invention during image heating operation, and a substantial perspective view (b) upon occurrence of sheet jamming.

The supporting member 5 (reinforcing member for reinforcing the holding member 4) is made of metal, resin material or the like, and is pressed by pressing means (unshown) at the longitudinal end portion. By pressing the sliding plate holding member 4 uniformly over the length, a uniform nip N is formed between the sliding plate 3 and the pressing roller 2 through the heating belt 1. In this embodiment, the supporting member 5 is a steel member having a thickness of 2 mm. The heater 6 is usually a lamp heater, and in this embodiment, it is a cylindrical halogen lamp. As shown in FIG. 2, the supporting member 5 has a U-shaped section and extends in parallel with the longitudinal direction of the heater. An opening is provided in an area opposed to the heating belt 1, and through the opening, the radiant light reaches the heating belt 1 from the heater.

Designated by 7 is a cylindrical rotatable protecting member having an opening 7*a* and a shield portion 7*b*. A length of the opening 7*a* measured in the longitudinal direction is equivalent to or no less than the width of the sheet capable of being processed by the apparatus. The opening 7*a* of the protecting member 7 has substantially one half area in a circumferential direction of the protecting member. The protecting member 7 is made of metal, resin material or the like, and in this embodiment it is a metal member having a thickness of 1-3 mm. When the recording material (unshown) is fed and is subjected to the heat-pressure fixing operation, the opening 7*a* of the protecting member 7 faces upward so as not to block the heat radiation from the heater 6. In addition, the inner surface of the protecting member 7 is a reflecting surface provided by specular surface treatment, for example.

As a sensor for discriminating sheet jamming, a sheet jamming detecting sensor 100 (FIG. 1) is disposed downstream of the image heating apparatus. The sheet jamming detecting means comprises a sensor (unshown) such as a photo-interrupter and a flag (unshown) of resin material or the like. When the flag disposed in the feeding path is laid down by the recording material P which is being fed, an optical path of the photo-interrupter is blocked (or opened) to detect the reaching of the recording material P using the sensor. And, presence or absence of the sheet jamming is discriminated depending on whether or not the recording material P reaches the sensor within a predetermined time period.

(Operation of Image Heating Apparatus)

The operation of said image heating apparatus will be described. FIG. 2 is a substantial perspective view of the image heating apparatus according to this embodiment. FIG. 2 is storing perspective view wherein the heating belt is removed, and shows the inside of the fixing device particularly, and therefore, a side plate for supporting the inside members of the fixing device and a driving gear or the like are omitted After the image forming apparatus starts the operation, the operation of the image heating apparatus starts at predetermined timing By a fixing motor (unshown), the pressing roller 2 is rotated, and by the driving force of the pressing roller 2, the heating belt 1 is driven.

The heater 6 is controlled by control means (unshown) in an ON-OFF manner. With the start of the drive of the pressing roller 2, the heater 6 is actuated to heat the inside structural members of the image heating apparatus and heat the back side of the heating belt 1, so that the heat required for the fixing operation is supplied.

In the normal sheet processing operation (image heating operation), the opening 7*a* of the protecting member 7 takes the first position for heating the belt 1 by the heater 6 (first disposition for the image heating) as shown in part (a) of FIG. 2, in which the opening 7*a* faces upward so as not to block the heat radiation from the heater 6 toward the heating belt 1. When the sheet jamming detecting sensor 100 (FIG. 1) detects occurrence of sheet jamming, the heating belt 1 deforms inwardly with the possible result that the inside of the heating belt 1 is brought into contact with the heater 6 and/or that the foreign matter on the inner surface of the heating belt 1 is deposited on the heater 6, and if it occurs, the heater 6 may be damaged.

Therefore, as shown in FIG. 1, the protecting member 7 is switched, by switching rotating means 300 with control means 200 interposed therebetween, from the image heating first position to the second position, in which the belt 1 is prevented from contacting the heater 6. More particularly, the protecting member 7 is rotated by 180° in the direction indicated by an arrow B in part (b) of FIG. 2 so that the shield portion 7*b* faces upward, by which the heater 6 is blocked from the heating belt 1, thus protecting the heater 6 from the heating belt or the foreign matter such as grease. The protecting member 7 extends to surround the heater 6 in the endless belt 1 and is rotatable around the heater 6. The protecting member 7 is provided with a shield portion 7*b* for blocking the endless belt 1 and the heater 6, and the opening 7*a*, the shield portion 7*b* and the opening 7*a* being disposed at different positions in the circumferential direction. Inside the endless belt 1, there is provided a reinforcing member 5 for reinforcing the back-up members 3 and 4 which extend in the longitudinal direction of the heater. The reinforcing member 5 is provided with an opening at a position opposing the endless belt, and the protecting member 7 is provided inside the reinforcing member5.

(Driving Force Transmission for Protecting Member)

Figure 3:
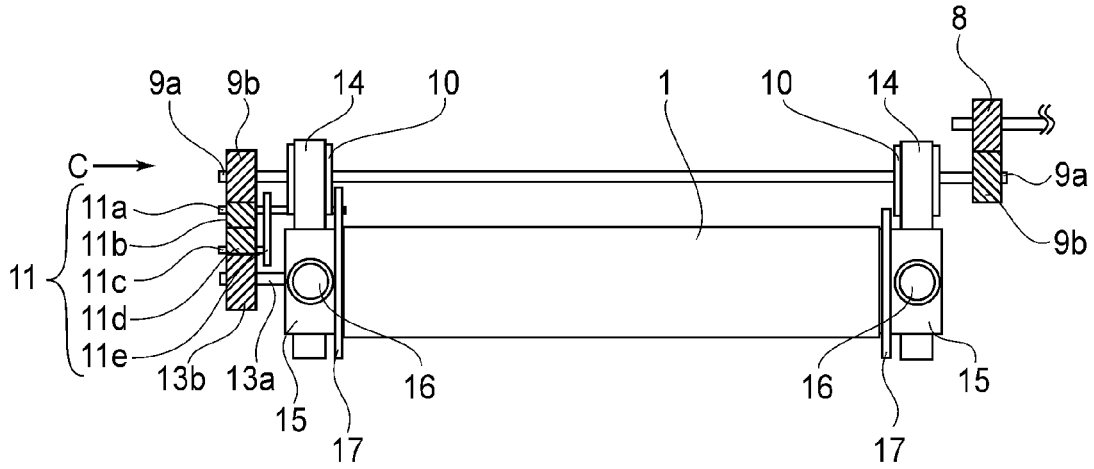
FIG. 3 is a schematic top plan view of the image heating apparatus according to the embodiment of the present invention.
Figure 4:
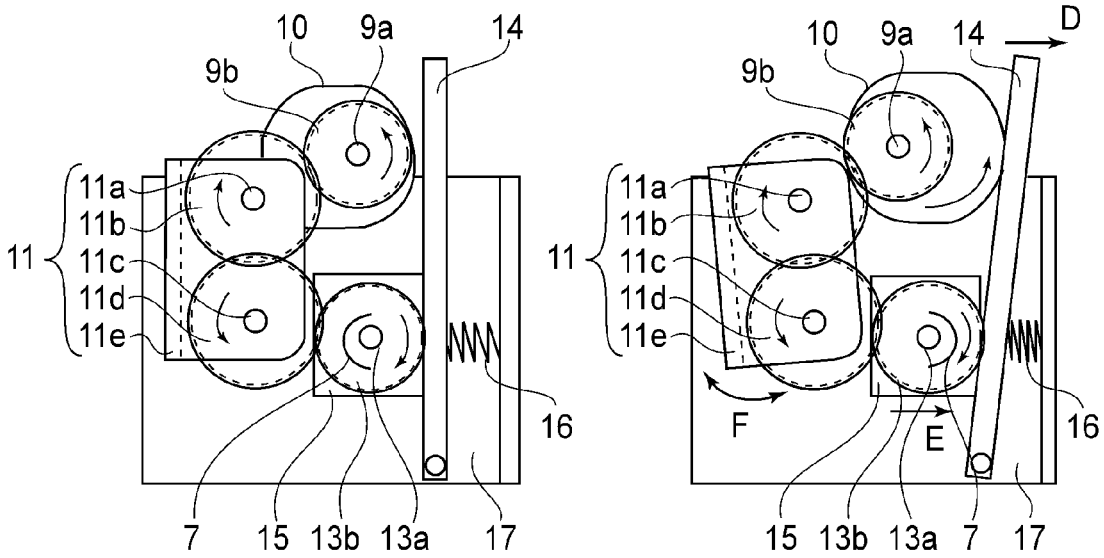
FIG. 4 is a view (a) as seen in a direction of an arrow C in FIG. 3 to illustrate a driving force transmission during the image heating operation, and a view of the driving force transmission upon the occurrence of the sheet jamming.

The structure for the driving force transmission for the protecting member will be described. FIG. 3 is a substantial top plan view of the image heating apparatus, and FIG. 4 is a view as seen in the direction C in FIG. 3. In the Figures, designated by reference numeral 14 is a pressing metal plate, and 15 is a fixing flange, 16 is an urging spring, and 17 is a side plate.

1) Pressure Release:

When the main assembly detects the sheet jamming by a sensor (unshown) provided in the feeding path, the image heating apparatus receives a power from an external driving source (unshown) through an external drive transmission gear 8 (FIG. 3) to rotate a gear 9*b* for spacing. Then, the driving force received from the external drive transmission gear 8 rotates a spacing cam 10 through a spacing gear 9*b* and a spacing cam driving shaft 9*a*, since the spacing cam driving shaft 9*a*, the spacing gear 9*b* and the spacing cam 10 shown in part (a) of FIG. 4 are rotated integrally. As shown in part (b) of FIG. 4, the spacing cam 10 displaces the pressing metal plate 14 in the direction of an arrow D.

By this, the pressing roller and the heating belt 1 is spaced in the direction of an arrow E to release the pressure of the nip, that is, the pressure between the pressing member and the belt member upon the occurrence of the sheet jamming can be made smaller than that during the normal image heating operation. By the pressure release, the pressure between the pressing member and the belt member is reduced or is made zero.

Simultaneously, the spacing gear 9*b* transmits the power to a swingable gear unit 11. The swingable gear unit 11 will be described. A fixed gear shaft 11*a* and a swingable gear shaft 11*c* are supported by a swingable gear holder 11*e*, and a fixed gear 11*b* is an idler gear for rotating the fixed gear shaft 11*a*, and a swingable gear 11*d* is an idler gear rotated the swingable gear shaft 11*c*. The swingable gear unit 11 swings the swingable gear shaft 11*a* in the direction indicated by an arrow F depending on a rotational moving direction of the fixed gear 11*b* about a fulcrum. The swingable gear unit 11 drives a protecting member driving gear 13*b* to rotate the protecting member driving gear 13*b* by 180° (rotation displacement).

2) Rotation Displacement of Protecting Member 7:

Here, the protecting member 7, the protecting member driving gear 13*b* and the protecting member driving shaft 13*a* are operable integrally, and therefore, the protecting member 7 receiving the driving force from the pendulum unit 11 rotates to the second position (rotation displacement) by 180° to block the heater 6 from the heating belt1. Thus, the spacing gear 9*b*, the fixed gear 11*b*, the swingable gear 11*d*, the protecting member driving gear 13*b*, the spacing cam 10 and the pressing metal plate 14 constitutes an example of the disposition switching means 300 (FIG. 1).

When the main assembly including the image heating apparatus is initialized after the jam clearance, the spacing cam 10 rotates, again. By this, the pressure is reapplied in the image heating apparatus to rotate the protecting member 7 by 180°, by which the opening 7*a* faces up and the shield portion 7*b* faces down (first position). The gear ratio between the spacing gear 9*b* and the protecting member driving gear 13*b* is 1, and therefore, one half of full rotation of the spacing cam 10 rotates the protecting member 7 by one half of full rotation. In this manner, in this embodiment, the switching between the first position for the image heating and the second position for the jam clearance are possible with a simple structure.

(Effects of this Embodiment)

As described in the foregoing, according to this embodiment, the cylindrical protecting member having an opening is provided around the heating source. Because of this feature, the opening can be made face up to expose the heating source to the heating belt, thus feeding the radiant heat to the heating belt in normal operation, and therefore, the radiant heat can be given to the heating belt efficiently. In addition, the inside of the cylindrical protecting member is specular surface or the like, so that in the normal heating operation (image heating operation), the heat radiation can be reflected toward the heating belt, thus raising the heat efficiency.

Figure 7:
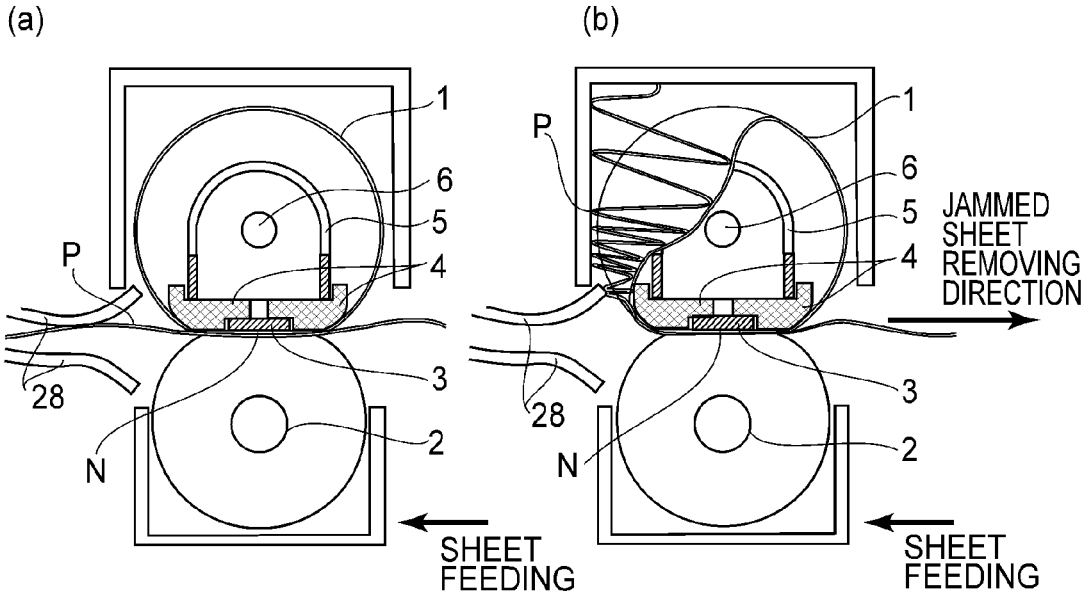
Prior Art FIG.7
FIG. 7 is a schematic sectional view (a) of an image heating apparatus using a belt type, and a schematic sectional view upon occurrence of the sheet jamming.

Furthermore, as shown in part (b) of FIG. 7, when a sheet jamming in the bellow form in a downstream side of the image heating apparatus in the image heating apparatus or when the jammed sheet is to be removed, the opening of the protecting member 7 can be made face down to cover the heating source. By this, even if the belt member is deformed by the jammed sheet toward the heating source, the existence of the protecting member before the heating source is effective to prevent the contact to the heating member or the deposition of the foreign matter.

More specifically, even if the heating belt is deformed downward, it can be avoided that the heating belt contacts the heating source or that the foreign matter such as grease on the inner surface of the heating belt is deposited on the halogen lamp, with the result of damage of the halogen lamp. In addition, an extreme inward deformation of the heating belt can be prevented, so that the heating belt can be protected.

Because of the structures of the interrelational operation with the pressure releasing operation, no driving source for operating the protecting member 7 is need, so that the number of the parts and the cost can be reduced. The protecting member 7 of this embodiment has a cylindrical shape partly cut away, it can be manufactured by bending an end portion of a U-shaped metal plate, and therefore is less expensive. The driving source for the protecting member 7 may be another motor which is actuated in response to a signal produced by the spacing cam 10.

<Second Embodiment>

Figure 6:
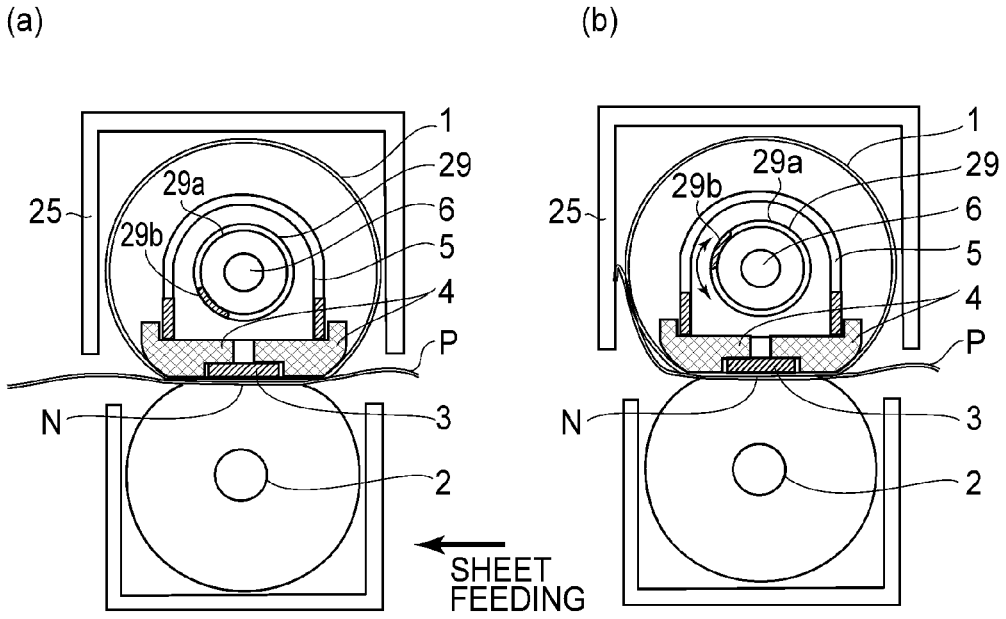
FIG. 6 is a schematic sectional view (a) of an image heating apparatus according to a second embodiment of the present invention, and a schematic sectional view (b) upon occurrence of the sheet jamming.

Referring to FIG. 6, the second embodiment will be described. In FIG. 6, designated by 29 is a protecting member having a configuration different from that of the first embodiment. The protecting member 29 covers approximately ¼ of the outer surface of the heater6. By this, the protecting member 29 is provided also with an opening in a side toward a sliding plate 3 and a sliding plate holding member 4, so that the heat can be supplied also to the sliding plate 3 and to the sliding plate holding member 4.

As shown in part (b) of FIG. 7, the sheet jamming often occurs downstream of the image heating apparatus, and therefore, the shield portion 29*b* of the protecting member 29 may be minimum as long as it suffices that when the heating belt 1 deforms inward downstream of the image heating apparatus 25, it enter between the heater 6 and the recording material to block the heater from the recording material.

The operation which is similar to that in the first embodiment will be described. In the normal sheet processing operation (image heating operation), as shown in part (a) of FIG. 6, the protecting member 29 is in the position for permitting the heat radiation to reach the heating belt 1 from the heater6. If the sheet jamming occurs, the protecting member 29 blocks the heating belt 1 at the sheet jamming position downstream of the image heating apparatus as shown in part (b) of FIG. 6 to protect the heater 6 from deformation of the heating belt and/or the foreign matter such as grease.

According to this embodiment, the similar effects as with the first embodiment, and in addition the heat can be supplied to the sliding plate 3 and to the sliding plate holding member 4, so that the heat efficiency can be raised, and therefore, the fixing property is further improved.

(Modified Example 1)

In the foregoing embodiments, the heating source provided at the position spaced from belt member is a halogen lamp, but this is not inevitable, and a metal line or another heating source is usable.

(Modified Example 2)

In the foregoing embodiments, the protecting member is switchable between the first position and the second position, but this is not inevitable. For example, an alternative structure is such that the protecting member placed in the first position is pulled out in the longitudinal direction (direction perpendicular to the sheet feeding direction), and is rotated to the second position and is inserted back in the longitudinal direction.

(Modified Example 3)

In the foregoing embodiments, the pressing member is a pressing roller as a driving roller, but this is not inevitable, and in an alternative structure, the heating belt is supported around a plurality of rollers, one of which is used as a driving roller, and the pressing member is a stationary pressing pad.

While the invention has been described with reference to the structures disclosed herein, it is not confined to the details set forth and this application is intended to cover such modifications or changes as may come within the purpose of the improvements or the scope of the following claims This application claims priority from Japanese Patent Application No. 249694/2011 filed Nov. 15, 2011 which is hereby incorporated by reference.

What is claimed is:

1. An image heating apparatus comprising:

an endless belt;

a heater, provided in an interior of said endless belt, configured to heat said endless belt;

a back-up member contacted to an inner surface of said endless belt;

a pressing member configured to form a nip for nipping and feeding a recording material together with said back-up member through said endless belt; and a cylindrical protecting member, provided surrounding said heater in the interior of said endless belt and rotatable around said heater, wherein said protecting member includes a shield portion configured to block contact, between said endless belt and said heater, and an opening, arranged in a circumferential direction of said protecting member.

2. An apparatus according to claim 1, further comprising a reinforcing member, provided in the interior of said endless belt, configured to reinforce said back-up member, said reinforcing member extending parallel to a longitudinal direction of said heater and being provided with an opening opposed to said endless belt, wherein said protecting member is disposed in the interior of said reinforcing member.

3. An apparatus according to claim 1, wherein said protecting member has an inner surface subjected to specular surface treatment.

4. An image forming apparatus comprising;

an image forming station configured to form an unfixed image on a recording material; and a fixing portion configured to heat and fix the unfixed image formed on the recording material on the recording material, wherein said fixing portion includes:

an endless belt;

a heater, provided in an interior of said endless belt, configured to heat said endless belt;

a back-up member contacted to an inner surface of said endless belt;

a pressing member configured to form a nip for nipping and feeding a recording material together with said back-up member through said endless belt; and a protecting member, provided surrounding said heater in the interior of said endless belt and rotatable around said heater, wherein said protecting member includes a shield portion configured to block contact between said endless belt and said heater, and an opening, arranged in a circumferential direction of said protecting member, wherein said protecting member rotates so as to place said shield portion between said endless belt and said heater in response to detection of an occurrence of jamming of the recording material.

5. An apparatus according to claim 4, further comprising a reinforcing member, provided in the interior of said endless belt, configured to reinforce said back-up member, said reinforcing member extending parallel to a longitudinal direction of said heater and being provided with an opening opposed to said endless belt, wherein said protecting member is disposed in the interior of said reinforcing member.

6. An apparatus according to claim 4, wherein said protecting member has an inner surface subjected to specular surface treatment.

7. An apparatus according to claim 4, further comprising a cam configured to release pressure of the nip in response to detection of the occurrence of jamming of the recording material.

8. An apparatus according to claim 7, wherein rotation of said protecting member and rotation of said cam are effected by the same power source.

9. An image heating apparatus comprising:

an endless belt;

a heater, provided in an interior of said endless belt, configured to heat said endless belt;

a back-up member contacted to an inner surface of said endless belt;

a pressing member configured to form a nip for nipping and feeding a recording material together with said back-up member through said endless belt; and a cylindrical protecting member, provided in an interior of said endless belt, configured to protect said heater, said protecting member being movable between a first position for permitting said heater to heat said endless belt and a second position for protecting said heater from being contacted by said endless belt.

10. An apparatus according to claim 9, further comprising a reinforcing member, provided in the interior of said endless belt, configured to reinforce said back-up member, said reinforcing member extending parallel to a longitudinal direction of said heater and being provided with an opening opposed to said endless belt, wherein said protecting member is disposed in the interior of said reinforcing member.

11. An apparatus according to claim 9, wherein said protecting member has a surface which faces said heater and is subjected to specular surface treatment.

12. An image forming apparatus comprising;

an image forming station configured to form an unfixed image on a recording material; and a fixing portion configured to heat and fixing the unfixed image formed on the recording material on the recording material, wherein said fixing portion includes:

an endless belt;

a heater, provided in an interior of said endless belt, configured to heat said endless belt;

a back-up member contacted to an inner surface of said endless belt;

a pressing member configured to form a nip for nipping and feeding a recording material together with said back-up member through said endless belt; and a protecting member, provided in an interior of said endless belt, configured to protect said heater, said protecting member being movable between a first position for permitting said heater to heat said endless belt and a second position for protecting said heater from being contacted by said endless belt, wherein said protecting member is moved to the second position in response to detection of an occurrence of jamming of the recording material.

13. An apparatus according to claim 12, further comprising a reinforcing member, provided in the interior of said endless belt, configured to reinforce said back-up member, said reinforcing member extending parallel to a longitudinal direction of said heater and being provided with an opening opposed to said endless belt, wherein said protecting member is disposed in the interior of said reinforcing member.

14. An apparatus according to claim 12, wherein said protecting member has a surface which faces said heater and is subjected to specular surface treatment.

15. An apparatus according to claim 12, further comprising a cam configured to release pressure of the nip in response to detection of the occurrence of jamming of the recording material.

16. An apparatus according to claim 15, wherein movement of said protecting member and rotation of said cam are effected by the same power source.

* * * * *